US006196497B1

(12) United States Patent
Lankes et al.

(10) Patent No.: US 6,196,497 B1
(45) Date of Patent: Mar. 6, 2001

(54) INFRARED SEEKER HEAD FOR TARGET SEEKING MISSILE

(75) Inventors: Simon Lankes; Michael Gross; Reiner Eckhardt, all of Überlingen; Heinz Hoch, Herdwangen, all of (DE)

(73) Assignee: Bodenseewerk Gerätetechnik GmbH, Überlingen/Bodensee (DE)

( * ) Notice: Subject to any disclaimer, the term of this patent is extended or adjusted under 35 U.S.C. 154(b) by 0 days.

(21) Appl. No.: 09/088,369

(22) Filed: Jun. 2, 1998

(30) Foreign Application Priority Data

Jun. 7, 1997 (DE) ..... 197 24 080

(51) Int. Cl.[7] ..... F41G 7/22; F42B 15/01

(52) U.S. Cl. ..... 244/3.17; 244/3.15; 244/3.16

(58) Field of Search ..... 244/3.1, 3.15, 244/3.16, 3.17, 3.18

(56) References Cited

U.S. PATENT DOCUMENTS

| | | | | |
|---|---|---|---|---|
| 3,564,257 | * | 2/1971 | Berry et al. | 244/3.16 X |
| 4,192,475 | * | 3/1980 | Heinrich | 244/3.16 |
| 5,062,586 | * | 11/1991 | Hobson et al. | 244/3.16 X |
| 5,077,465 | | 12/1991 | Wagner et al. . | |
| 5,376,794 | | 12/1994 | Gross et al. . | |

FOREIGN PATENT DOCUMENTS

| | | |
|---|---|---|
| 39 25 942 C2 | 2/1991 | (DE) . |
| 195 20 318 A1 | 12/1996 | (DE) . |
| 0 538 671 B1 | 4/1993 | (EP) . |
| 0 604 790 A2 | 7/1994 | (EP) . |
| 2 740 638 A1 | 4/1997 | (FR) . |
| 2 751 479 A1 | 1/1998 | (FR) . |
| 2 301 662 | 12/1996 | (GB) . |

* cited by examiner

*Primary Examiner*—Bernarr E. Gregory
(74) *Attorney, Agent, or Firm*—McDermott, Will & Emery

(57) ABSTRACT

An infrared seeker head for target tracking missiles has a main detector and an imaging optical system generating an image of a field of view on the main detector. The field of view contains a target such as an enemy aircraft. The missile is guided to the target in accordance with signals from the main detector. The target, if attacked by the missile, emits high-intensity laser radiation towards the missile as a counter-measure. This is to disturb the operation of the seeker head by dazzling or even destroying the main detector. The seeker head contains a device for defending against such disturbances. Various types of such defending devices are described. Incident light is deviated from the main detector. A second-quadrant-detector of reduced sensitivity guides the missile along the disturbing laser beam. Another embodiment uses attenuating optical elements in front of the main detector under the control of one or more second detectors.

25 Claims, 5 Drawing Sheets

INFRARED SEEKER HEAD FOR TARGET SEEKING MISSILE

TECHNICAL FIELD

The invention relates to an infrared seeker head for target seeking missiles, in which a field of view is imaged, by means of an imaging optical system, on a main detector which detects a target located in the field of view.

STATE OF THE ART

There are manifold prior art infrared seeker heads for missiles.

EP patent 0 538 671, for example, discloses an infrared seeker head for target seeking missiles. The seeker head consists of an optical system, which is mounted on an inner gimbal and an outer gimbal and is universally movable relative to a structure. The optical system generates an image of a field of view on a detector. Signals are obtained which cause the seeker to be directed at a target which is detected, by means of two gimbal servomotors.

German patent 3,925,942 discloses a gyro-stabilised, seeker. The seeker consists of an imaging optical system, by which a field of view is imaged on a detector. The detector generates target signals, from which direction signals are generated. Directing signal cause the rotational axes of a rotor to follow target. The detector is arranged in a Dewar vessel and is cooled.

To defend against attacking target seeking missile, measures are taken by an attacked aircraft for causing interference in the infrared seeker head.

Prior art infrared seeker heads for guided missiles usually have analog signal processing and use a reticle. To deceive the signal processing of such seeker heads, it is sufficient if a suitably modulated infrared radiation source, (infrared jammer) emits interfering radiation at the target site. This radiation source may be a laser with large beam divergence, or a plasma lamp, as a relatively small radiation level is sufficient to cause interference.

Modern picture processing infrared seeker heads are no longer as easily deceived. An interference could be achieved, in which the laser radiation is focused on the approaching missile. Then by dazzling and even destruction of the infrared detector, the guidance of the missile could be totally interrupted and the missile would miss the thus protected target.

DISCLOSURE OF THE INVENTION

It is an object of the invention to reduce the possibilities of disturbing the function of an infrared seeker head for missiles.

According to the invention this object is achieved in that the seeker head is provided with a device to eliminate interference generated by high intensity radiation emitted from the target towards the missile.

This device to eliminate interference from high intensity radiation—usually a laser beam aimed at the seeker head of the missile—may be of different types. Different solutions, which may be used individually or in suitable combination are the subject matter of the sub-claims.

An embodiment of the invention is described in detail hereinbelow with reference to the accompanying drawings.

PREFERRED EMBODIMENTS OF THE INVENTION

Figure 1:
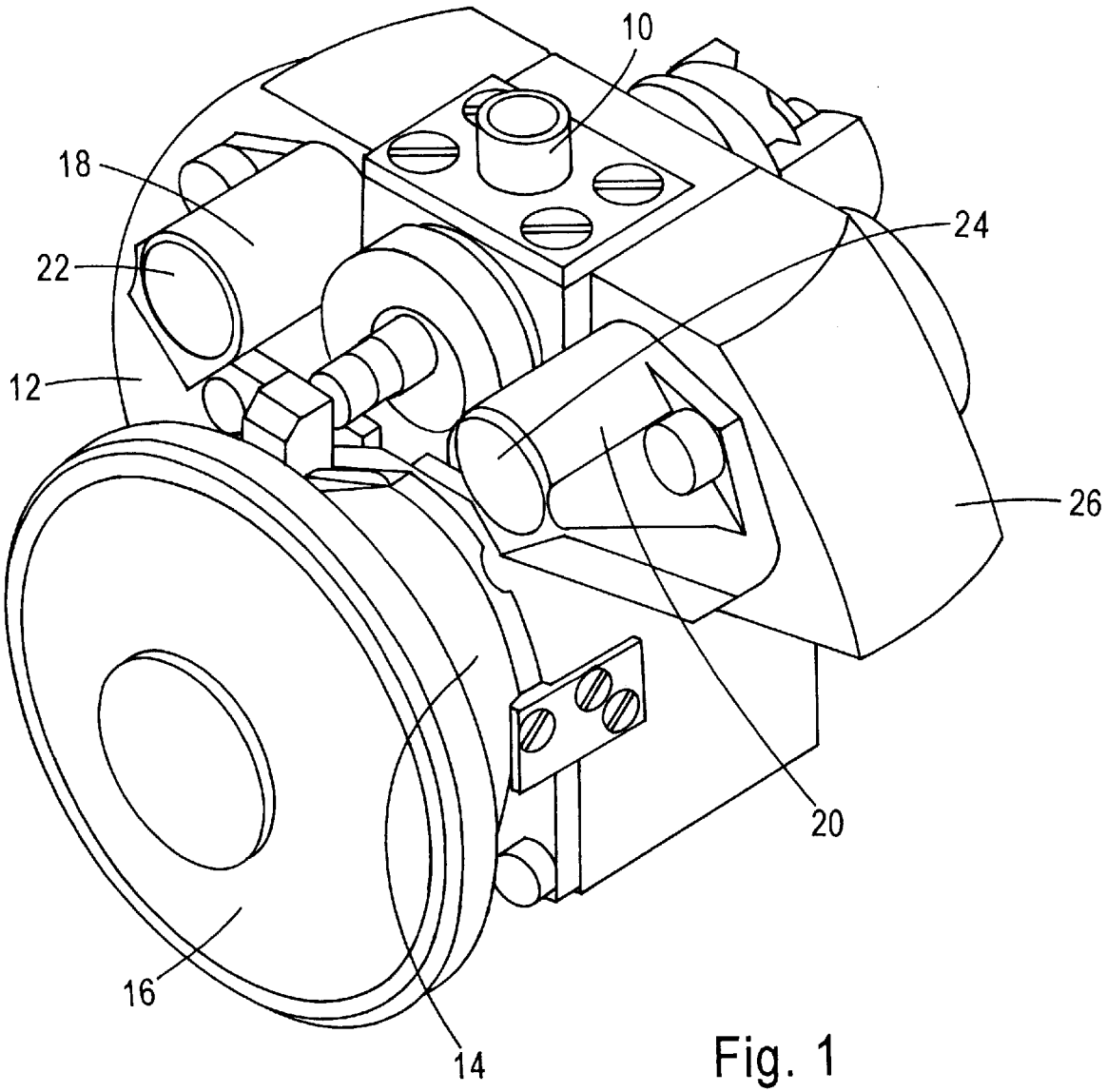
FIG. 1 is a schematic, perspective illustration and shows an embodiment of the infrared seeker head of the invention.

An infrared seeker head is illustrated schematically in FIG. 1. The seeker head may be located in the nose of an air-to-air missile and be protected by a dome which is transparent to infrared radiation. The infrared seeker head is rotatably mounted around an axis 10 on the inner gimbal 12 of a gimbal system. The inner gimbal 12 carries the complete opto-electronical receiver system, the optical axis of which is directed towards the target by rotating the axes of the gimbal system appropriately. A first detector system 14 consists of an infrared optical system 16 as an imaging optical system. This detector system 14 forms a conventional passive infrared detector, which responds to heat radiation. The infrared optical system 16 images a field of view (and the target) on an infrared linear detector array, as main detector, by means of a scanning device arranged behind the optical system and having a movable optical deflection member. The data derived therefrom, is directed further to a structure-fixed signal processing unit arranged in the missile.

A second detector system is arranged close to the first detector system 14 on the inner gimbal 12. In the embodiment illustrated in FIG. 1, the second detector system as "a second detector", consists of two laser detector modules 18 and 20 which respond to laser radiation. The optical axes of the two laser detector modules 18 and 20 are orientated in a well defined manner, relative to the optical axis of the first detector system 14. The fields of view of the two laser detector modules 18 and 20 are harmonised with the field of view of the first detector system 14, in such a way, that laser interference in the complete scanned region of the first detector system 14 can be detected.

The use of two laser detector modules 18 and 20 offers the advantage, that the second detector system can detect the laser radiation, even if, in the case of high look angles, either of the laser detector modules 18 or 20 is covered by the dome mounting or some other structural element, depending on the direction of deflection of the gimbal axes.

The laser detector modules 18 and 20 each consist of a four-quadrant detector and an entry lens 22 or 24. The laser radiation which is received, is imaged unfocused on the four-quadrant detector in accordance with conventional measuring methods.

The electronics of the seeker head are located in a housing 26 on the inner gimbal 12.

Figure 2:
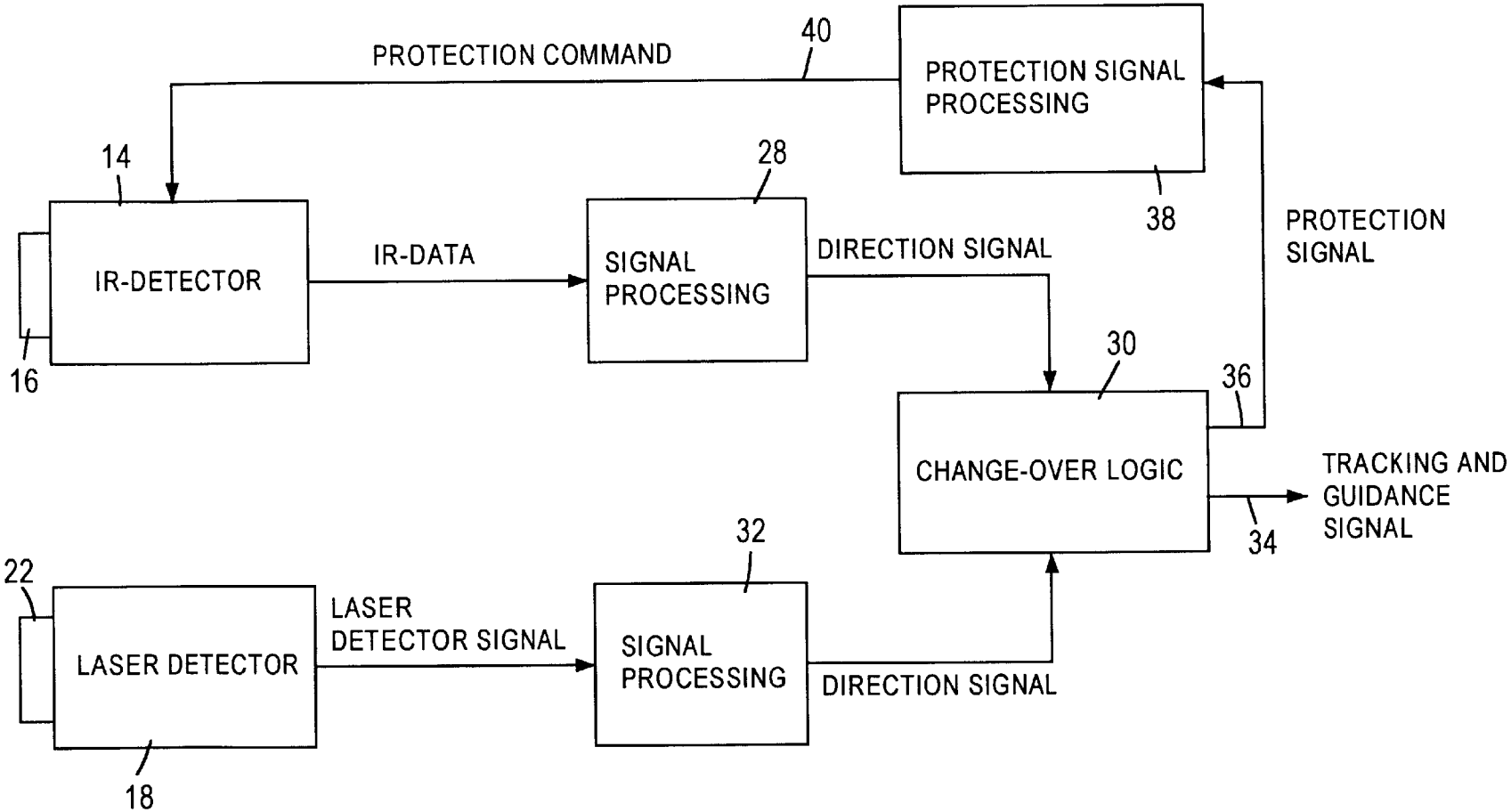
FIG. 2 is a block diagram and illustrates the signal processing of an infrared seeker head of the the invention.

In FIG. 2, the signal processing of the infrared seeker head of FIG. 1 is illustrated in a block diagram. The signal (infrared data) is applied to a signal processing unit 28 of the first detector system 14. These signals are evaluated in the signal processing unit 28 and directing signals are generated. The directing signals of the signal processing unit 28 are applied to a change-over logic 30, which provides direction and guidance signals for directing the seeker head and guiding the missile. This is indicated by an arrow 34.

Of the two laser detector modules 18 and 20, only the first laser detector module 18 is illustrated in FIG. 2. The signals of the four-quadrant detector of the laser detector module 18 are applied to signal processing 32. In the signal processing 32, this signal is evaluated and directing signals are produced. These direction signals are also applied to the change-over logic 30.

In the case where no interference is present, i.e. if no laser radiation is detected by the second detector system, the directing of the seeker head and the missile guidance are changed over to the direction signal of the signal processing unit 28 of the first detector system 14. If a threat is detected by the target and a laser beam is directed from the target at the approaching missile, may be interrupted by this directing signal might disturb the signal processing, and the signal processing might become unusable for the guidance of the missile. When such laser disturbance starts, the signal of the second detector system as well as the signal of the first detector system 14 undergo a sudden change. This change is recognised by the change-over logic 30. The change-over logic 30 is then operative to change the directing of the seeker head and the missile guidance over to the directing signal of the signal processing unit 32 of the second detector system. This may be effected by processing and digitizing the analog output data of the quadrant detector in the electronics, if a predetermined threshold is exceeded.

When the laser radiation is detected, a protection signal 36 is further generated by the change-over logic 30, such signal serving to initiate measures for protecting the first detector system 14. As illustrated in FIG. 2, the protection signal 36 is applied to a protection signal processing unit 38, which provides a protection command to the first detector system 14 at an output 40. In the illustrated embodiment, the field of view of the first detector system 14 is scanned with a scanning device. As a protection measure, on the occurrence of the protection signal, the movable, optical, deflecting element of the scanning device is retained in a position, in which the linear detector array of the first detector system 14 is not impinged upon by the laser radiation.

Figure 4:
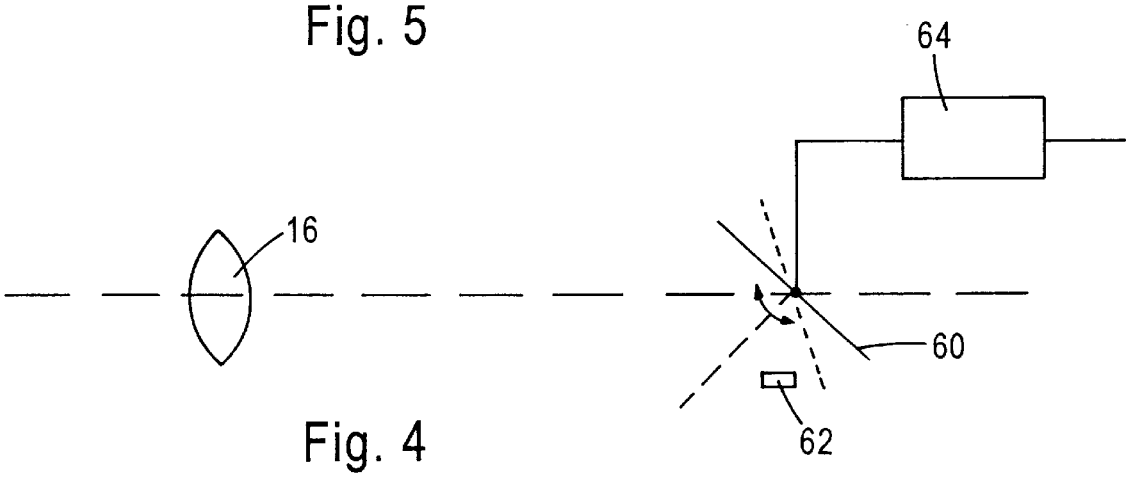
FIG. 4 shows an embodiment, in which the field of view is scanned by means of a linear detector array using an oscillating mirror and, on the occurrence of high intensity radiation, the mirror is moved into a position, in which, in normal operation, the linear detector array is not exposed to the interference radiation.

This is illustrated schematically in FIG. 4. There, the imaging optical system is again designated the numeral 16 and is simply illustrated as a lens. The imaging optical system 16 images a field of view at infinity, via a movable optical deflecting device 60, in the plane of a linear detector array 62. The optical deflecting device 60 is moved by a drive 64. The deflecting device 60 is illustrated in FIG. 4 as an oscillating mirror. The oscillating movements are indicated by a double arrow. The linear detector array 62 is a linear arrangement of detector elements, which extend normal to the plane of the paper in FIG. 4. On the occurrence of a protection command at the output 40 (FIG. 2), the deflecting device 60 is brought to the position illustrated by the broken line in FIG. 4, by means of the drive 64. In this position, the deflecting device 60 diverts all the radiation that is picked up on the systems 16 field of view past the linear detector array 62.

The protection means may however take another form:

The first detector system may be protected by attenuating means. These attenuating means may be a mechanical diaphragm or a no-inertia optical attenuating element (e.g. an electro-optical Kerr-cell).

Figure 5:
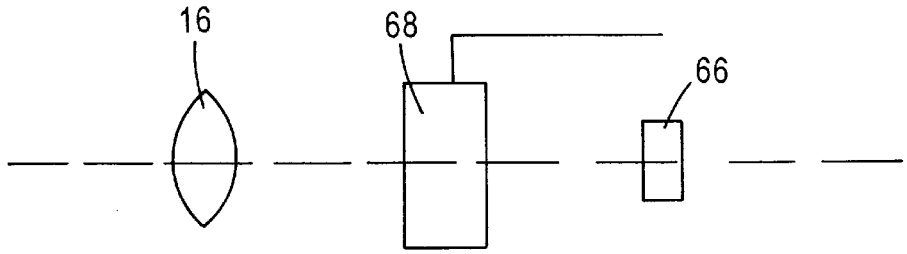
FIG. 5 shows an embodiment, in which a mechanical or electro-optical diaphragm arranged in front of the main detector is closed as a protection measure, to protect the main detector from high intensity interference radiation.

This is schematically illustrated in FIG. 5. In the embodiment in FIG. 5, which may in other respects be similar to the embodiment in FIGS. 1 to 3, the imaging optical system 16 generates an image of the field of view in the plane of an infrared-sensitive CCD-Matrix detector 66. An attenuating element 68 is placed in front of the CCD-Matrix detector 66, and is controlled by the protection command at the output 40. In FIG. 5, the attenuating element is a Kerr cell.

Beam deflection means may also be provided, which deflect the radiation from the main detector, on the occurrence of the protection signal. This may be realised in a simplified manner by means of an oscillating deflecting mirror, which, on the occurrence of the protection signal, is rotated into a position so that the radiation no longer falls on the main detector.

Figure 6:
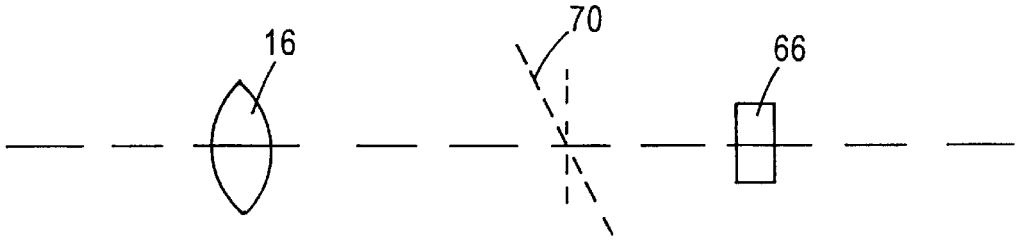
FIG. 6 shows an embodiment, in which a mirror oscillates in the path of rays, the mirror, as a protection measure, deflecting the disturbing radiation away from the main detector to protect the main detector from high intensity interference radiation.

This is illustrated in FIG. 6. There, the imaging optical system is again designated by the numeral 16, and the matrix detector (or another two-dimensional arrangement of detector elements) is designated by the numeral 66. On the occurrence of a protection command, a deflecting mirror 70 is rotated into the imaging path rays, which is drawn in broken lines in FIG. 6.

If laser radiation has been detected and the seeker head is in the laser-guided mode of operation, there will be a continuous check, whether the laser radiation is interrupted. If this is the case, the system is changed back to the regular infrared mode of operation.

Figure 3:
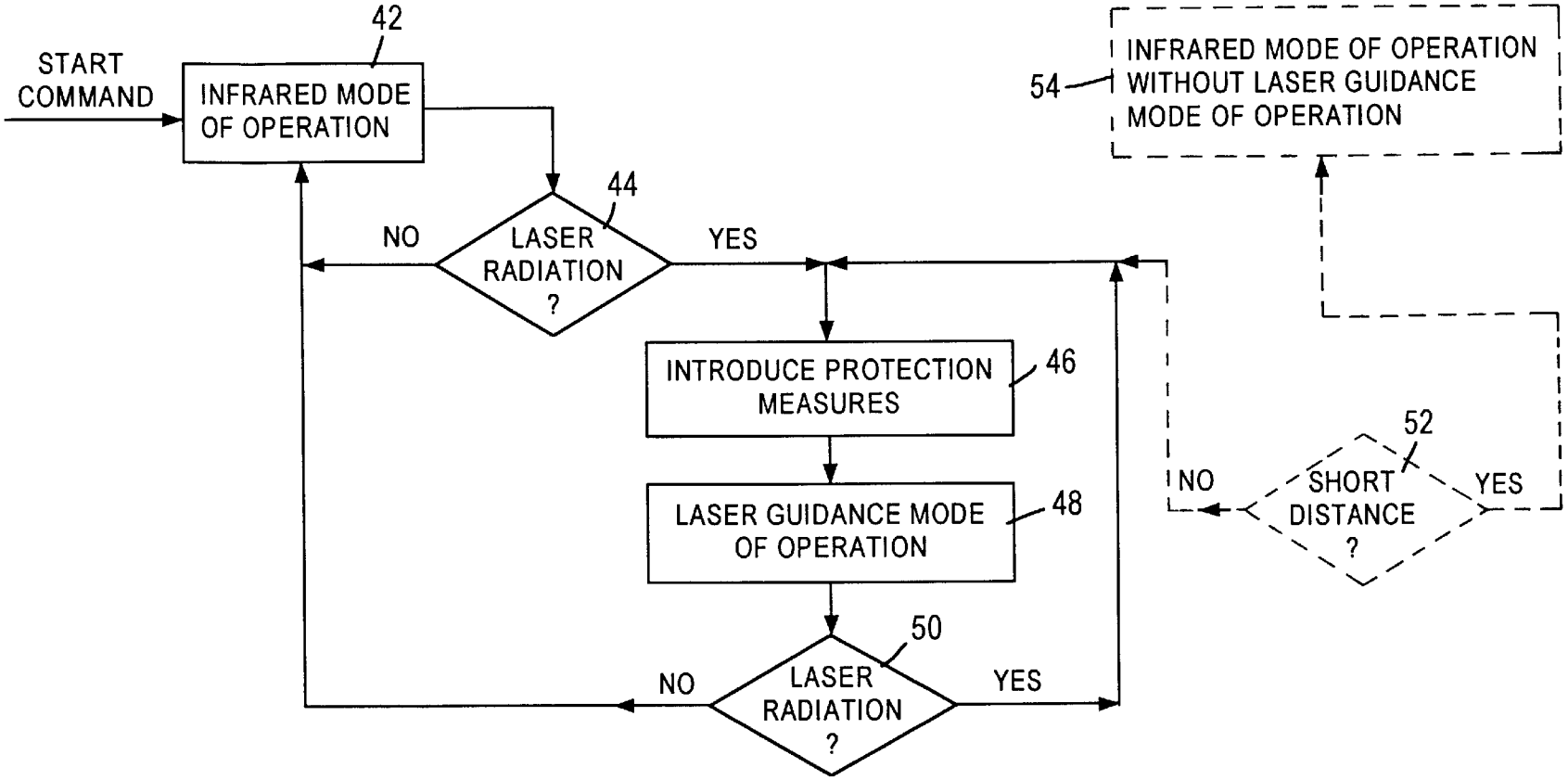
FIG. 3 is a flow chart and illustrates the control of the infrared seeker head of the invention and, in addition, an optional mode of operation of the infrared seeker head.

In FIG. 3 the change-over procedure between the two modes of operation is illustrated in a flow chart. Furthermore, an optional procedure is illustrated where the distance between the missile and the target is short. To begin with, it is assumed that the seeker head is in the regular infrared operating mode. This is illustrated by block 42. An inquiry takes place (block 44), whether laser radiation is received or not. If no laser radiation is received ("No"), then the seeker head remains in the infrared mode of operation. If laser radiation is received ("Yes"), then the protection measures are introduced for the first detector system 14 (comparable to the change-over logic 30 in FIG. 2). This is illustrated by block 46. Simultaneously, the seeker head is changed over to the laser-guidance mode of operation (block 48). A new inquiry takes place (block 50), whether laser radiation continues to be received. If no more laser radiation is received ("No"), the seeker head is changed back to infrared mode of operation (block 42). If laser radiation is received ("Yes"), then the seeker head remains in the laser-guidance mode of operation (block 46). This procedure corresponds to the illustration in FIG. 2 and it is illustrated by solid lines in FIG. 3.

Optionally, it may be checked whether the target is located at a short distance from the infrared seeker head. In this case, the target image is larger than the laser interference in the image, so that at least part of the target in the signal processing unit 28 of the first detector means 14 is recognised and "valid" direction signals may be generated. This procedure is illustrated with broken lines in FIG. 3. If laser radiation continues to be detected ("Yes"), in the laser-guidance mode of operation (block 48), during the inquiry (block 50), an inquiry takes place in this case, whether the target is located at a short distance. This is illustrated in block 52. If this is not the case ("No"), then the seeker head remains in the laser guided mode of operation (Block 48). If the target is located at a short distance ("Yes"), then the seeker head is changed over to the infrared mode of operation (Block 54).

Figure 7:
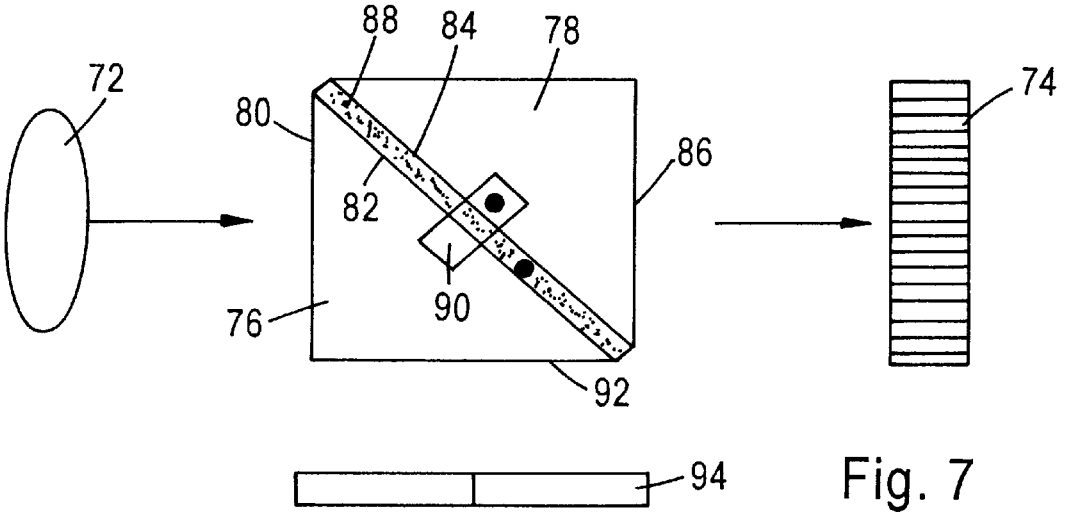
FIG. 7 shows an embodiment, in which two prisms are arranged in a position to be moved relative to each other by means of a piezo-actuator, such that, light picked up from the optical system is directed to a main detector.
Figure 8:
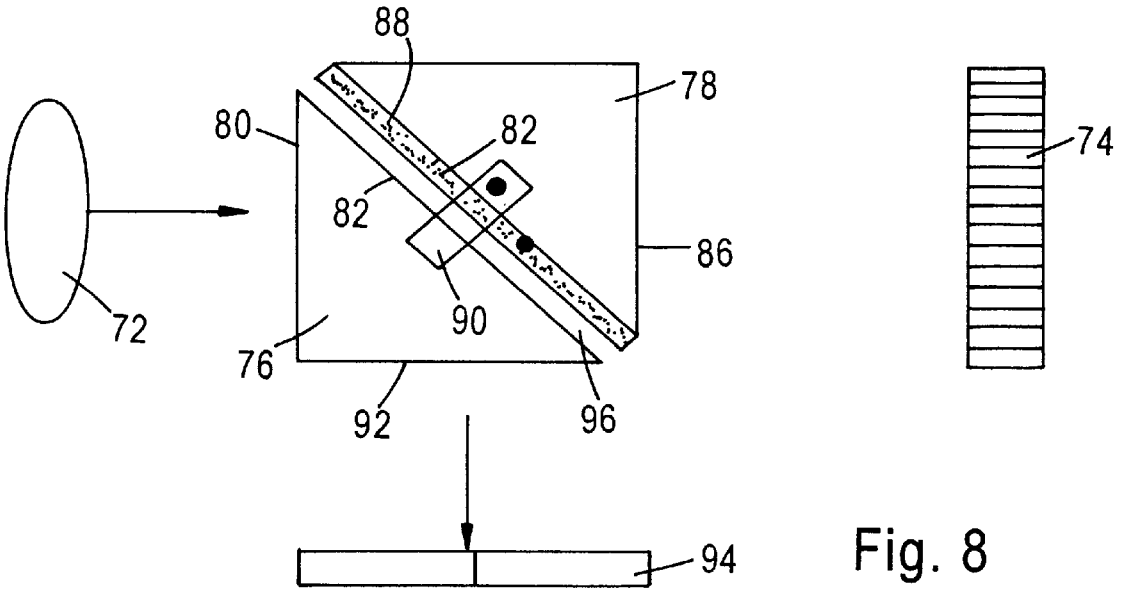
FIG. 8 shows the embodiment of FIG. 7 in a position, in which the light picked up from the optical system is directed to an auxiliary detector, which is dimensioned to endure the high intensity interference radiation.

In the embodiment of FIGS. 7 and 8 an imaging optical system 72, which is illustrated as a lens, generates an image of a field of view on a CCD-Matrix detector 74. A pair of complementary prisms 76 and 78 are arranged in the path of rays.

The prisms 76 and 78 form equi-angular, right-angled triangles in cross-section, the hypotenuses of the triangles facing each other. The prism 76 has an entry surface 80 and an inclined surface 82 facing the prism 78. The prism 78 has an inclined surface 84 parallel to the inclined surface 82 and facing the prism 76, and an exit surface 86 parallel to the entry surface 80. The inclined surface 84 is coated with a semiconductor layer 88. The semiconductor layer 88 is transparent to infrared radiation, which is received by the CCD-Matrix detector 74 but has non-linear absorption behaviour. This non-linear absorption behaviour may, for example, be caused by a two-photon process. The non-linear absorption behaviour has the consequence that, the semiconductor layer has a high transmission to the low intensities of the infrared radiation, to which the CCD matrix detector 74, as main detector, is usually exposed, but heavily absorbs high intensities as generated by a laser directed from the target to the missile.

The two prisms 76 and 78 are movable between a first position illustrated in FIG. 7 and a second position illustrated in FIG. 8 by means of a piezo-actuator 90 relative to each other and normal to the plane of both the inclined surfaces 82 and 84. The prism 76 has an exit surface 92 normal to the entry surface 80. The plane of the exit surface 92 is normal to the plane of the exit surface 86 of the prism 78.

A second detector 94 is arranged opposite to the exit surface 92. The second detector 94 responds to the high intensity radiation, namely the laser beam which is directed at the missile from the target. Here, the second detector 94 is a detector which is less sensitive to radiation than the main detector 74. The second detector 94 should recognise the incidence of high intensity radiation. It needs not respond to the weak self radiation emitted by a distant target, as the main detector does. The second detector 94 is a four-quadrant detector.

In the first position of the prisms 76 and 78 (FIG. 7), the imaging optical system 72 forms a focused image of the field of view on the CCD matrix detector 74 through the two prisms 76 and 78 and the layer 88. In the second position of the prisms 76 and 78 (FIG. 8), a narrow air gap 96 is formed, by means of the piezo-actuator 90, between the inclined surfaces 82 of the prism 76 and the semiconductor layer 88 applied to the inclined surface 84. The width of the air gap 96 may be in the order of the wavelength of light. The air gap 96 leads to a total reflection occurring on the inclined surface 82 of the prisms 76. The optical system 72 generates an image, not on the CCD matrix detector 74, but on the second detector 94. Imaged thereon is substantially the source of the high intensity radiation. This image on the detector 94 is somewhat unfocused. The detector 94 is a four-quadrant detector.

During an "integration-time" analog signals are produced from the incident light on the individual detector elements of the CCD matrix detector, the signals representing the time integral of the light falling on the detector element. During a subsequent "read-out" time, the detector elements are read out line by line. This alternation from integration and read-out time occurs cyclically. Therefore, useful information of the CCD matrix detector is only provided from the light incident during the integration time. During the read-out time, the imaging beam of light may be removed from the CCD matrix detector 74, without, thereby, adversely affecting the sensitivity of the CCD matrix detector.

In the arrangement illustrated in FIGS. 7 and 8, the prisms are in the position shown in FIG. 7 during the integration time and are brought to the read-out position shown in FIG. 8 during the read-out time. The light impinges upon the CCD matrix detector during the integration time only. During the read-out time, the light is directed by means of the total reflection at the inclined surface 82 onto the second detector 94. Thereby—without loss in sensitivity during normal operation—the radiation incident on the CCD-matrix detector 74 is reduced by the ratio of the integration time to the total time (integration time plus read-out time). That does not matter during normal operation; it reduces, however, the exposure of the CCD matrix detector 74, during the incidence of high intensity radiation, such as a laser beam emitted from the target. In the case of a continuous-wave laser, the high intensity radiation affecting the CCD matrix detector 74 may be reduced to an amount, at which less risk of damage or destruction of the CCD matrix detector 74 exists.

The change-over between the first position in FIG. 7 and the second position in FIG. 8 may be effected at rather high frequency by means of the piezo-actuator 90.

The arrangement described offers a still further advantage: During the read-out times, the light is cyclically directed also onto the second detector 94. The second detector 94 detects the occurrence of high intensity radiation. When such radiation is detected, the prisms 76 and 78 may be retained in their second position. Thus, the CCD matrix detector 74 is completely shielded from the incident radiation.

Now an image of the light source of the high intensity radiation is generated on the second detector 94, which is formed as a four-quadrant detector. The four-quadrant detector deliveries target position signals from the laser beam, by means of which the missile is guided to the target. While the laser beam causes the highly sensitive CCD matrix detector 74 to malfunction, it itself provides a means to guide the missile to the target.

If the laser beam ceases, a change-over to the normal operation immediately takes place: the prisms are brought to the position of FIG. 7, and the CCD matrix detector 74 resumes the observation of the target. This also happens when the laser beam is pulsed.

A prism arrangement with a piezo-actuator, as described in FIGS. 7 and 8 may also be used instead of the mirror 7 in FIG. 6.

Due to the cyclic changing-over between the positions in FIG. 7 and FIG. 8, during the integration time and the read-out time of the CCD matrix detector 74, and/or the arranging of the semiconductor layer 88 having non-linear absorption behaviour in front of the CCD-matrix detector, the high intensity radiation may be attenuated to such an extent that, the CCD matrix detector 74 itself, without changing over to a detector 94, may resume the guidance of the missile to the source of the high intensity radiation without being dazzled or damaged.

We claim:

1. An infrared seeker head for target seeking missiles, comprising main detector means responsive to infrared target radiation, imaging optical means for imaging a field of view on said main detector means, said main detector means responding to infrared emitting targets in the field of view, wherein said seeker head further comprises interference eliminating means for avoiding interference of said main detector means, said interference being caused by interference radiation emitted by said target towards said missile, said interference radiation having an intensity detrimental to said main detector means.

2. An infrared seeker head as claimed in claim 1, wherein said interference eliminating means comprise second detector means responding to said interference radiation.

3. An infrared seeker head as claimed in claim 2, wherein said second detector means comprise a detector of a type, the function of which is not disturbed by said interference radiation.

4. An infrared seeker head as claimed in claim 3, wherein said second detector means comprise a position sensitive detector, which responds to the position of a source of said interference radiation.

5. An infrared seeker head as claimed in claim 4, and further comprising (a) means for deriving first missile guidance signals from signals from said main detector means and second missile guidance signals from said second detector means, (b) guidance means for guiding said missile alternatively in response to said first missile guidance signals or in response to said second missile guidance signals, (c) change-over means for applying said first missile guidance signals to said guidance means, if said second detector means is not exposed to said interference radiation, and for applying said second missile guidance signals to said guidance means, if said second detector means is exposed to said interference radiation, (d) whereby said missile, if exposed to said interference radiation from said target, is then guided towards the source of said interference radiation by said second missile guidance signals.

6. An infrared seeker head as claimed in claim 2, wherein said interference eliminating means comprises protecting means for protecting said main detector means from said interference radiation, said protecting means being activated by signals from said second detector means.

7. An infrared seeker head as claimed in claim 6, wherein said protecting means comprise beam attenuating means located in front of said main detector means for attenuating radiation impinging thereon upon activation, said attenuating means being activated by signals from said second detector means on the occurrence of said interference radiation.

8. An infrared seeker head as claimed in claim 6, wherein (a) said main detector means comprises a linear detector array (b) said imaging optical system comprising a movable, optical, deflecting element in front of said detector array for cyclically scanning said field of view and (c) said interference eliminating means comprises means, responding to said second detector means being exposed to said interference radiation, for moving said optical deflecting element to a position, in which, said linear detector array is not exposed to the radiation from the imaging optical system.

9. An infrared seeker head as claimed in claim 6, and further comprising radiation deflecting means for deflecting radiation directed to said main detector means, said deflecting means being activated by said second detector means being exposed to said interference radiation.

10. An infrared seeker head as claimed in claim 9, wherein said beam deflecting means comprise a pair of complementary prisms with a pair of faces adjacent each other, and piezoelectric actuating means for moving said prisms between a first relative position, in which an air gap is defined between said adjacent faces, whereby incident light is totally reflected and deviated from said main detector means, an a second relative position, in which the adjacent faces are in contact, whereby incident light passes through said adjacent faces to said main detector means.

11. An infrared seeker head as claimed in claim 10, wherein said interference eliminating means comprise a filter layer applied to one face bordering said air gap of said prism, said filter layer being of the type the transparency of which decreases with increasing intensity of the incident radiation.

12. An infrared seeker head as claimed in claim 1, wherein (a) said main detector means comprises a CCD matrix detector with a two-dimensional array of detector elements, each of said detector elements accumulating a pixel signal during an integration time, each of said detector elements being read out during a read-out time, (b) said imaging optical system comprising controlled, optical, beam-deflecting means in front of said main detector means, (c) said optical, beam-deflecting being controlled in synchronism with the read-out of the CCD matrix detector to cyclically deflect light directed on said CCD-matrix detector during said read-out time.

13. An infrared seeker head as claimed in claim 1, wherein said interference eliminating means comprise a filter layer in front of said main detector means, said filter layer being of the type the transparency of which decreases with increasing intensity of the incident radiation.

14. An infrared seeker head as claimed in claim 1, and further comprising means for deactivating said interference eliminating means, if, in the case of short distance between the missile and the target, the image of said target on said main detector means becomes larger than the image of said source of said interference radiation.

15. An infrared seeker head for target seeking missiles, comprising main detector means responsive to infrared target radiation, imaging optical means for imaging a field of view on said main detector means, said main detector means responding to infrared emitting targets in the field of view, wherein said seeker head further comprises interference eliminating means for avoiding interference of said main detector means, said interference being caused by interference radiation emitted by said target towards said missile, said interference radiation having an intensity detrimental to said main detector means, wherein said interference eliminating means comprise second detector means responding to said interference radiation, wherein said second detector means comprise a position sensitive detector, which responds to the position of a source of said interference radiation.

16. An infrared seeker head as claimed in claim 15, and further comprising (a) means for deriving first missile guidance signals from signals from said main detector means and second missile guidance signals from said second detector means, (b) guidance means for guiding said missile alternatively in response to said first missile guidance signals or in response to said second missile guidance signals, (c) change-over means for applying said first missile guidance signals to said guidance means, if said second detector means is not exposed to said interference radiation, and for applying said second missile guidance signals to said guidance means, if said second detector means is exposed to said interference radiation, (d) whereby said missile, if exposed to said interference radiation from said target, is then guided towards the source of said interference radiation by said second missile guidance signals.

17. An infrared seeker head as claimed in claim 15, wherein said interference eliminating means comprises protecting means for protecting said main detector means from said interference radiation, said protecting means being activated by signals from said second detector means.

18. An infrared seeker head for target seeking missiles, comprising main detector means responsive to infrared target radiation, imaging optical means for imaging a field of view on said main detector means, said main detector means responding to infrared emitting targets in the field of view, wherein said seeker head further comprises interference eliminating means for avoiding interference of said main detector means, said interference being caused by interference radiation emitted by said target towards said missile, said interference radiation having an intensity detrimental to said main detector means, wherein said interference eliminating means comprise second detector means responding to said interference radiation, wherein said interference eliminating means comprises protecting means for protecting said main detector means from said interference radiation, said protecting means being activated by signals from said second detector means independently of signal from said main detector means.

19. An infrared seeker head as claimed in claim 18, wherein said protecting means comprise beam attenuating means located in front of said main detector means for attenuating radiation impinging thereon upon activation, said attenuating means being activated by signals from said second detector means on the occurrence of said interference radiation.

20. An infrared seeker head as claimed in claim 18, wherein (a) said main detector means comprises a linear detector array, (b) said imaging optical system comprising a movable, optical, deflecting element in front of said detector array for cyclically scanning said field of view, and (c) said interference eliminating means comprises means, responding to said second detector means being exposed to said interference radiation, for moving said optical deflecting element to a position, in which, said linear detector array is not exposed to the radiation from the imaging optical system.

21. An infrared seeker head for target seeking missiles, comprising main detector means responsive to infrared target radiation, imaging optical means for imaging a field of view on said main detector means, said main detector means responding to infrared emitting targets in the field of view, wherein said seeker head further comprises interference eliminating means for avoiding interference of said main detector means, said interference being caused by interference radiation emitted by said target towards said missile, said interference radiation having an intensity detrimental to said main detector means, wherein (a) said main detector means comprises a CCD matrix detector with a two-dimensional array of detector elements, each of said detector elements accumulating a pixel signal during an integration time, each of said detector elements being read out during a read-out time, (b) said imaging optical system comprising controlled, optical, beam-deflecting means in front of said main detector means, (c) said optical, beam-deflecting means being controlled in synchronism with the read-out of the CCD matrix detector to cyclically deflect light directed on said CCD-matrix detector during said read out time.

22. An infrared seeker head for target seeking missiles, comprising main detector means responsive to infrared target radiation, imaging optical means for imaging a field of view on said main detector means, said main detector means responding to infrared emitting targets in the field of view, wherein said seeker head further comprises interference eliminating means for avoiding interference of said main detector means, said interference being caused by interference radiation emitted by said target towards said missile, said interference radiation having an intensity detrimental to said main detector means, wherein said interference eliminating means comprise second detector means responding to said interference radiation, wherein said interference eliminating means comprises protecting means for protecting said main detector means from said interference radiation, said protecting means being activated by signals from said second detector means, and further comprising radiation deflecting means for deflecting radiation directed to said main detector means, said deflecting means being activated by said second detector means being exposed to said interference radiation, wherein said beam deflecting means comprise a pair of complementary prisms with a pair of faces adjacent each other, and piezoelectric actuating means for moving said prisms between a first relative position, in which an air gap is defined between said adjacent faces, whereby incident light is totally reflected and deviated from said main detector means, an a second relative position, in which the adjacent faces are in contact, whereby incident light passes through said adjacent faces to said main detector means.

23. An infrared seeker head as claimed in claim 22, wherein said interference eliminating means comprise a filter layer applied to one face bordering said air gap of said prism, said filter layer being of the type the transparency of which decreases with increasing intensity of the incident radiation.

24. An infrared seeker head for target seeking missiles, comprising main detector means responsive to infrared target radiation, imaging optical means for imaging a field of view on said main detector means, said main detector means responding to infrared emitting targets in the field of view, wherein said seeker head further comprises interference eliminating means for avoiding interference of said main detector means, said interference being caused by interference radiation emitted by said target towards said missile, said interference radiation having an intensity detrimental to said main detector means, wherein said interference eliminating means comprise a filter layer in front of said main detector means, said filter layer being of the type the transparency of which decreases with increasing intensity of the incident radiation.

25. An infrared seeker head for target seeking missiles, comprising main detector means responsive to infrared target radiation, imaging optical means for imaging a field of view on said main detector means, said main detector means responding to infrared emitting targets in the field of view, wherein said seeker head further comprises interference eliminating means for avoiding interference of said main detector means, said interference being caused by interference radiation emitted by said target towards said missile, said interference radiation having an intensity detrimental to said main detector means, and further comprising means for deactivating said interference eliminating means, if, in the case of short distance between the missile and the target, the image of said target on said main detector means becomes larger than the image of said source of said interference radiation.

* * * * *